United States Patent [19]

Carstens

[11] 4,452,723

[45] Jun. 5, 1984

[54] NON-SKID SURFACE COMPOSITIONS FOR PAPER PRODUCTS

[75] Inventor: Ronald Carstens, Anacortes, Wash.

[73] Assignee: Key Tech Corporation, Redmond, Wash.

[21] Appl. No.: 528,052

[22] Filed: Aug. 31, 1983

Related U.S. Application Data

[60] Division of Ser. No. 406,340, Aug. 9, 1982, Pat. No. 4,418,111, which is a continuation-in-part of Ser. No. 252,035, Apr. 8, 1981, abandoned.

[51] Int. Cl.[3] ..... B01J 13/00; C09K 3/14

[52] U.S. Cl. ..... 252/313 S; 106/36; 106/287.34

[58] Field of Search ..... 428/331, 452, 145, 150, 428/537, 411, 141; 106/287.34; 252/313 S; 427/397.7, 384, 387, 391

[56] References Cited

U.S. PATENT DOCUMENTS

| | | | |
|---|---|---|---|
| 2,268,674 | 1/1942 | Roth | 106/287.34 |
| 2,383,653 | 8/1945 | Kirk | 252/313 S |
| 3,649,348 | 3/1972 | Vossos | 428/331 |
| 3,901,987 | 8/1975 | Payne | 428/331 |
| 3,916,058 | 10/1975 | Vossos | 428/331 |
| 4,418,111 | 11/1983 | Carstens | 428/145 |

OTHER PUBLICATIONS

Ralph Iler, "The Chemistry of Silica", publisher John Wiley & Sons, 1979, pp. 288–355.

*Primary Examiner*—Ellis P. Robinson
*Attorney, Agent, or Firm*—Holman & Stern

[57] ABSTRACT

A composition is disclosed, which when applied to the surface of a paper product, such as a corrugated board, improves the slip-angle. The composition, consisting of an aqueous suspension of colloidal silica and urea, finds particular utility in products resulting from recycled paper.

12 Claims, No Drawings

NON-SKID SURFACE COMPOSITIONS FOR PAPER PRODUCTS

CROSS-REFERENCE TO A RELATED APPLICATION

This is a divisional of application Ser. No. 406,340 filed Aug. 9, 1982 now U.S. Pat. No. 4,418,111, which in turn is a continuation-in-part of application Ser. No. 252,035 filed Apr. 8, 1981, now abandoned.

BACKGROUND OF THE INVENTION

1. Field of the Invention

This invention relates to non-skid surface compositions applied to the surface of a material. More particularly, this invention is directed to silica containing non-skid surface compositions applied to paper products such as paperboard and most particularly prepared from reprocessed or recylced paper.

2. Description of the Prior Art

Recycled paper has traditionally been manufactured on slow cylinder machines forming the paper at a speed of 100 to 250 feet/minute. Formerly, the products resulting from such processes were used largely as speciality items, such as shirt backs, cartons, folders, etc. As the trend of recycling has increased, recycled paper in small percentages has started to appear in linerboard used in container manufacturing. Recently, the development of high speed cylinder machines such as the Escher-Wysch German machine, as well as innovations permitting the use of shorter recycled fibers on conventional high speed Fourdrinier machines, has allowed recycled fiber to command an increasing share of linerboard production. Today, there are many mills which are capable of manufacturing paper products containing between 60% and 100% recycled fiber and some which employ as little as approximately 10% recycled fiber. The use of such a large percentage of recycled fiber in the finished paper has led to increasing problems in the handling of the paper, both in the mill and at converters, because of its increased slipperiness. This loss in the coefficient of friction is due to the shorter fibers which result from the additional processing required by recycling as compared to virgin paper fibers, as well as from contaminants introduced with the used paper. These contaminants include dirt, wax, cold and hot melt adhesives, water proofing, and other special coatings, etc. Various paper fiber procesing techniques have been employed to remove some of these contaminants prior to paper formation but have had only marginal success in removing the wax-like contaminants which cause the paper to become slippery. Thus, the combination of shorter recycled fibers and wax-like contaminants have had a detrimental effect on the finished linerboard coefficient of friction, or slip-angle, as it is commonly measured by the TAPPI method. For instance, virgin linerboard will generally have TAPPI-method slip-angles of between 20° and 25°. Typical linerboard made with a modicum of recycled fiber will have slip-angles of from 15° to 20°, and some boards having a high percentage of recycled fibers, and their concomitant contaminants, can have slip-angles of between 10° and 15°. Slip-angles of less than 20° are the cause of several paper handling problems. First, in the paper mill itself it may be difficult to rewind the sheet as it would tend to "wander" along the reel. Additionally, when clamp trucks attempt to lift finished rolls of paper for shipping, the center of the reel may telescope out. In a paperboard plant, such as one which produces corrugated board or forms containers from such materials, additional problems arise since it is difficult to keep the corrugator running in-line as the board tends to "wander". Frequently, the finished boxes are so slippery that they cannot be moved around the plant or to a customer without difficulty.

Traditionally, this problem has been solved by applying a dispersion of a colloidal silica non-skid agent by any one of a number of application methods. In lower speed machines, a water box application has been successfully used. In high speed machines, the colloidal silica has been applied as a surface coating by the "size" press in the paper mill. More commonly, however, a series of low pressure sprays apply the material to the sheet as it is being wound on its final reel. While these methods have enjoyed some success, the increased cost of materials and processing have diminished the financial savings anticipated as a result of using recycled paper.

SUMMARY OF THE INVENTION

It is an object of the present invention to provide an improved non-skid composition which, when applied to the surface of a paper product, one which is produced either from virgin stock or containing at least a portion of recycled fiber, particularly the latter, yields better slip-angles than similar compositions known heretofore.

It is a further object of the present invention to provide non-skid, silica-containing compositions at a lower cost than other similar commercially available compositions.

The non-skid compositions according to the present invention involve the combination of urea with an aqueous sol or suspension of colloidal silica. The use of urea in combination with the colloidal silica provides a dual benefit in achieving better slip-angles.

First, the presence of urea provides the surface of a material coated with the composition according to the present invention with a more permanent and constant coefficient of friction. A common characteristic of paper board coated with colloidal silica compositions is a tendency to undergo a diminution of the coefficient of friction upon abrasion. The presence of dissolved urea in the coating composition according to the instant invention, however, provides a finished product with a more durable surface having a slip-angle which is less susceptible to change with time and abrasion than comparable silica coated products. This seems to result from the effect of urea on the surface of the colloidal silica which appears to be caused by the influence of the urea on the hydrolysis of the silica. Thus, testing has suggested that adhesion of the non-skid composition of the present invention is significantly better than prior art compositions, and the non-skid properties initially imparted to the substrate are maintained with little change through subsequent processing of the paper. Equally important are the concomitant health and practical advantages of using the instant compositions. In comparision to prior art non-skid compositions which produce large amounts of dust during various process steps taking place after the composition has been applied to the substrate, the compositions of the present invention result in relatively little dust being formed, particularly during rewinding. This apparently results from improved adhesion and the nature of the dried compositions. Accordingly, there is less dust formed which workers could inhale during the processing and less particulate matter deposited on the machines employed and any particulate matter which is formed with the present compositions is a type which may be easily wiped off machine parts, rather than the cementitious nature of prior art compositions which clings to and interferes with machinery. Secondly, the urea in the present invention serves to "blind" or "encapsulate" wax particles which accompany the recycled paper and contribute to its slipperiness. While urea has been employed in the petroleum industry to form inclusion compounds or "clathrates" to dewax motor oil and gasoline, such use involves the separation of the adducted waxes from the remaining petroleum fraction. In the present invention, once the wax has been complexed or encapsulated, it is unnecessary to remove the material from the surface of the paper product. Thus, the urea clathrating agent serves a dual function of promoting silica slip-angle stability or consistency as well as blinding any wax present from exerting its natural tendency to cause sheet slipperiness or diminished coefficient of friction.

Since one of the primary objects of the present invention non-skid compositions is to encapsulate wax or wax-like particles, the present invention contemplates the use generally of clathrating agents, another example of which is thiourea. However, when considerations of cost and effectiveness are taken into account, urea is the preferred compound.

DESCRIPTION OF THE PREFERRED EMBODIMENTS

According to the present invention, the urea may be combined with a silica sol or colloidal suspension of silica in any convenient manner. Thus, the urea may be dissolved in water and then combined with the colloidal silica sol and the concentrations of the components adjusted by proper dilution. Alternatively, the urea may be added directly to the sol. The normal non-skid treatment employed by many paper mills consists of spraying a dilute dispersion of colloidal silica on the surface of the paper product. The colloidal silica solutions are frequently commercially supplied as 50% by weight dispersions. In use, these dispersions are diluted to approximately 7.5% by weight solids (that is, the percentage of solids which would result from evaporation to dryness). It has been found that when the present invention is used, a lower concentration of colloidal silica may be employed to obtain higher slip-angles than when colloidal silica alone is used.

While various combinations of silica and urea have proved suitable, it has been found that a urea/silica weight ratio of between 0.10 and slightly greater than 3.00 is most effective. The maximum value of the ratio being determined by cost versus effectiveness considerations. The most preferred ratio, however, is between 0.2 and 1.0.

Experiments have indicated that mean particle sizes of the colloidal silica should fall within the range of 10 to 150 millimicrons. The preferred mean particle size comprises a range of 20 to approximately 125 millimicrons and the most preferred mean particle size range appears to be approximately 60 to 100 millimicrons with the latter figure offering optimum results.

It has been found that the present invention is effective with colloidal silica present in the range of approximately 1 to 5% by weight, based on the total weight of the composition. Preferably, the colloidal silica should be present in concentrations of approximately 2 to 4% by weight, based on the total weight of the composition, with 3% by weight representing the preferred concentration of colloidal silica. However, the precise concentration can be varied on an even wider scale depending upon particular application methods and conditions within the skill of the artisan.

The aqueous non-skid compositions of the present invention are effective in the basic range, that is, at pH values slightly above 7 to approximately 11. The preferred pH range is approximately 8.5 to 10.5, but the vast majority of commercially available colloidal silica sols, having pH values in the range of 8.5 to 10, are quite suitable. It appears that a basic solution is required in order to place a charge on the silica, a situation not possible in an acidic solution. Although the present invention improves the non-skid properties of both virgin and recycled fiber stocks, particularly when used with colloidal silica in the above-indicated preferred range of particle sizes, it has demonstrated the greatest improvements when applied to substrates formed at least in part of recycled fibers. The latter includes those materials having as little as 10% by weight of recycled paper up to 100% recycled paper. Skid or diminished friction becomes a problem most often in paper products used as containers, such as in the formation of corrugated board. In such instances the source of the recycled fiber is the broad category of used paper, generally, and most often is used corrugated board, newspaper or bags. However, the present invention may be used in any application employing virgin or recycled fiber from any source. Thus, to form appropriate colloidal silica sols, that is, suspensions containing well defined particles within a suitable size range, a crystal growing process must occur and once the desired properties are achieved, the sold is stabilized. This growth stage could involve an aging period of hours or days without affecting the effectiveness of the instant composition. Once the particles have reached the desired size, further growth is halted by stabilization with an appropriate alkaline reagent. The alkaline reagent appears to stabilize the silica particles by providing a suitable pH range and cations. Suitable alkaline reagents include the alkali metal hydroxides and ammonium hydroxide with the preferred hydroxides being sodium and potassium hydroxide. The most preferred compound is sodium hydroxide. The normal procedure involves initial preparation of the colloidal silica sol aging and growth of the particles, stabilization and addition of clathrating agent.

EXAMPLES

In Examples 1 to 3, summarized in Table I, an Escher-Wysch paper former was employed to make 368 T/D of 37 pound linerboard. The linerboard was sprayed with non-skid agent after passing from the calendar stack and before arriving at the reel. Spray nozzles with a 0.036 inch effective diameter were employed operating at 10 psi and arranged at 28 inches above the sheet. The untreated linerboard was composed of five (5) layers of fully recycled paper which was subject to various treatment steps prior to sheet formation to remove dirt and wax. Paperboard which had no non-skid agent applied to its surface (i.e., untreated) had a slip-angle (TAPPI method) of 17° to 18°.

In Example 1, a conventional non-skid treatment was applied to the surface of the linerboard. This consisted of spraying a dilute solution (7.5% by weight of solids) of colloidal silica, received originally as a 50% by weight solution (commercially available as Nalcoag 1050 from Nalco Chemical Company, Chicago, Ill.).

Examples 2 and 3 represent examples using the present invention. In both cases, the original colloidal silica suspension was diluted with a solution of urea to provide a stock solution. This stock solution was further diluted to provide a working solution which was sprayed on the surface of the linerboard. The concentration of the working solution was approximately 7.5% by weight of total solids.

Some of the variables employed in these experiments and the results obtained are summarized in Table I.

The following should be noted with respect to Table I. The same composition and concentrations were used in Examples 2 and 3. Also, while the same working concentration (approximately 7.5% by weight of total solids) was employed in all of the above experiments, colloidal silica represented a lower concentration in Examples 2 and 3, than in Example 1, as is indicated by the weight of original 50% colloidal silica suspension/-ton of paper. Slip-angles were measured both on the reel and subsequently on the winder. The designates "A", "B", and "C" represent the average of three measurements taken at three (3) positions across the width of the linerboard, corresponding approximately to one edge, the center, and the opposite edge. As a result of a number of variables, the averages of the three (3) measurements taken across the width of the linerboard are more meaningful than the individual values. The should also be noted that the above results were obtained employing colloidal silica having mean particle sizes of between 10 to 20 millimicrons.

TABLE I

| Example No. | Non-Skid Composition Used As Stock Solution | lbs. of 50% colloidal silica per ton paper | Slip-Angles Measured On The Reel | | | | Slip-Angles Measured On The Winder | | | |
|---|---|---|---|---|---|---|---|---|---|---|
| | | | A | B | C | Avg | A | B | C | Avg |
| 1 | 50 wt. % colloidal silica* | 5.1 | 26 | 25 | 27 | 26.0 | 24 | 22 | 25 | 23.6 |
| 2 | 50 wt. % solids 33 wt. % colloidal silica* 15 wt. % urea | 3.1 | 26 | 26 | 27 | 26.3 | 24 | 24 | 27 | 25.0 |
| 3 | Same as Example 2 | 3.1 | 25 | 28 | 25 | 26.0 | 28 | 25 | 25 | 26.0 |

*In all cases the colloidal silica had mean particle sizes of 10–20 millimicrons.

Colloidal silica non-skid agents are characteristically noted for their tendency to lose slip-angle upon handling. Thus, it may be observed that the average slip-angle decreases by an expected 2 to 3° in passing a conventionally treated linerboard (Example 1) from the reel to the winder. The average slip-angles for linerboards treated according to the present invention (Examples 2 and 3) decrease a much smaller amount. It should be observed that these results are obtained although the amount of colloidal silica used according to the method of the present invention is substantially less than that used according to the conventional non-skid coatings.

While Examples 1 to 3 demonstrate the improved and consistent slip-angle obtained by using the present invention, as well as the decreased colloidal silica requirements of the instant invention used to obtain such improved results, Examples 4 to 6, summarized in Table II, demonstrate, according to the present invention, desirable concentrations of colloidal silica as well as preferred mean particle sizes. The treated fiber board samples were obtained, as described for Examples 1 to 3, by spraying a diluted solution of the non-skid agent directly onto the surface of the corrugated paperboard formed from virgin paper. Spraying was done after the corrugated paperboard left the drying section and at a rate of 400 feet/minute. The board used in Examples 4 to 6 was 175 pound Kraft corrugated board which exhibited a slip-angle of 18° to 19° for the untreated board. The solutions were applied at a rate of 0.30 pounds of working solution per thousand square feet of board surface. The column designations, "1st Angle" and "2nd Angle" represent subsequent measurements made according to TAPPI procedure.

TABLE II

| Example # | Initial Concentrate Compositions (i.e. stock solutions prior to dilution) | Slip Angles* 1% Si Content As Applied 1st Angle | 1% Si Content As Applied 2nd Angle | 3% Si Content As Applied 1st Angle | 3% Si Content As Applied 2nd Angle |
|---|---|---|---|---|---|
| 4 | 33% Colloidal Silica 20 millimicrons avg particle size 15% Urea | 25.6 | 28.0 | 31.8 | 32.4 |
| 5 | 33% Colloidal Silica 100 millimicrons avg particle size 15% Urea | 31.8 | 34.4 | 33.3 | 35.8 |
| 6 | 33% Colloidal Silica 100 millimicrons avg particle size | 30.8 | 33.6 | 29.8 | 34.2 |

*Average of five samples. Measurements made according to TAPPI procedure. Tappi, January 1967, Vol. No. 1, p206A, "Coefficient Of Static Friction Of Shipping Sack Papers (Inclined Plane Method)".

As is indicated by the results summarized in Table II, as well as those in Table I, optimum slip-angles are obtained at colloidal silica concentrations of the working solution which are approximately 3% by weight of the overall composition. In addition, Example 5 indicates that compositions according to the present invention provide better slip-angles with silica having a mean particle size of approximately 100 millimicrons.

It should now be apparent that the objects initially set forth have been successfully achieved. Moreover, while there is shown and described present examples of the invention, it is to be distinctly understood that the invention is not limited thereto, but may be otherwise variously embodied and practiced within the scope of the following claims.

What is claimed is:

1. A composition comprising an alkaline aqueous sol of colloidal silica having a pH greater than 7 to approximately 11 and a mean particle size in the range of 10 to 150 millimicrons, and an agent selected from the group consisting of urea and thiourea.

2. The composition of claim 1, wherein the ratio of weight of said agent to said colloidal silica is between 0.1 to 3.00.

3. The composition of claim 1, wherein the ratio by weight of said agent to said colloidal silica is between 0.2 to 1.0.

4. The composition of claim 1, wherein said colloidal silica has a mean particle size in the range of 20 to 125 millimicrons.

5. The composition of claim 1 wherein said colloidal silica comprises 1 to 5 percent by weight, based on the total weight of said composition.

6. The composition of claim 1, wherein said colloidal silica comprises 2 to 4 percent by weight, based on the total weight of said composition.

7. The composition of claim 1, wherein said agent is urea.

8. The composition of claim 1, wherein said agent is thiourea.

9. The composition of claim 1, wherein said alkaline aqueous sol has a pH in the range of approximately 8.5 to 10.5.

10. The composition of claim 1, wherein said composition includes an alkali metal hydroxide or ammonium hydroxide.

11. The composition of claim 10, wherein said alkali metal hydroxide is sodium hydroxide or potassium hydroxide.

12. The composition of claim 1, wherein said colloidal silica has a mean particle size in the range of 60 to 100 millimicrons.

* * * * *